US012601258B2

(12) United States Patent
Li

(10) Patent No.: US 12,601,258 B2
(45) Date of Patent: Apr. 14, 2026

(54) UNDERGROUND RESERVOIR MONITORING SYSTEM

(71) Applicant: Shanjun Li, Katy, TX (US)

(72) Inventor: Shanjun Li, Katy, TX (US)

( * ) Notice: Subject to any disclaimer, the term of this patent is extended or adjusted under 35 U.S.C. 154(b) by 181 days.

(21) Appl. No.: 18/163,981

(22) Filed: Feb. 3, 2023

(65) Prior Publication Data

US 2024/0263556 A1 Aug. 8, 2024

(51) Int. Cl.
*E21B 49/08* (2006.01)
*E21B 47/13* (2012.01)

(52) U.S. Cl.
CPC ..... *E21B 49/0875* (2020.05); *E21B 47/13* (2020.05)

(58) Field of Classification Search
CPC ..... E21B 47/13; E21B 49/0875
See application file for complete search history.

(56) References Cited

U.S. PATENT DOCUMENTS 2,141,826 A * 12/1938 Doll ..... G01V 3/22 324/366
2,317,304 A * 4/1943 Doll ..... G01V 3/20 324/366
4,739,325 A * 4/1988 MacLeod ..... G01V 3/24 340/854.6
4,882,542 A * 11/1989 Vail, III ..... G01V 3/24 324/368
6,480,000 B1 * 11/2002 Kong ..... E21B 49/00 324/338
7,151,377 B2 * 12/2006 Chouzenoux ..... G01V 3/20 324/375
7,436,184 B2 * 10/2008 Moore ..... G01V 3/24 324/355
7,673,682 B2 * 3/2010 Daily ..... E21B 47/017 166/241.6
10,450,852 B2 * 10/2019 San Martin ..... E21B 47/01
10,704,377 B2 * 7/2020 Barfoot ..... E21B 47/113
2003/0220750 A1 * 11/2003 Delhomme ..... E21B 43/20 702/50
2014/0191120 A1 * 7/2014 Donderici ..... E21B 47/135 250/265
2020/0183043 A1 * 6/2020 Li ..... G01V 3/20
2024/0191619 A1 * 6/2024 Fouda ..... H04B 5/79

* cited by examiner

*Primary Examiner* — D. Andrews
(74) *Attorney, Agent, or Firm* — MagStone Law, LLP; Enshan Hong

(57) ABSTRACT

The present application provides an underground reservoir monitoring system for real-time monitoring changes of reservoir parameters. The system measures the alternating current signal when an alternating current passes through the transceiver along the casing, and calculates the alternating current flow parameters including phase velocity, group velocity, time difference, amplitude attenuation, and phase difference of the alternating current along the casing based on the alternating current signal. Each alternating current flowing parameter has a one-to-one relationship with the reservoir parameter. Using these relationships, reservoir parameters are calculated and used to monitor changes of the reservoir parameters.

8 Claims, 20 Drawing Sheets

UNDERGROUND RESERVOIR MONITORING SYSTEM

FIELD OF THE INVENTION

The present application relates to the field of monitoring underground oil, gas, water, CO2 reservoirs, which may be referred to as monitoring changes of reservoir parameters, such as resistivity, water saturation, pressure, temperature, and permeability. More specifically, in one embodiment, there are provided designs of reservoir monitoring systems and signal measurements that may provide measurements of reservoir resistivity and water saturation.

BACKGROUND OF THE INVENTION

To optimize oil and gas development, or to frequently monitor reservoirs used to store CO2, we need a monitoring system that may easily measure the reservoir parameters, such as water saturation, resistivity, and porosity as required. The reservoir resistivity is a key parameter used to calculate water saturation. So far, oil companies have relied on cased hole logging to measure reservoir parameters, which is inconvenient and costly. What's more, there is no reliable and efficient cased hole resistivity logging tool on the market. Therefore, there is a need to provide more reliable and efficient methods and systems for measuring reservoir parameters, such as water saturation, resistivity, and porosity.

SUMMARY OF THE INVENTION

The invention provides a reservoir monitoring system, which may monitor the changes of the reservoir parameters, such as reservoir resistivity and water saturation, by measuring alternating current flowing parameters, such as phase velocity, group velocity, phase difference, amplitude attenuation, and time difference when alternating current flows along the casing, at different times.

According to an embodiment of the present invention, a methodology is presented, which measures alternating current signals, including real part and image part, and/or phase and amplitude of the alternating current, voltage, electric field, and magnetic field in frequency domain or time domain, to compute alternating current flowing parameters, including phase velocity, group velocity, phase difference, amplitude decay, and time difference. The alternating current flowing parameters are related to reservoir parameters, such as reservoir resistivity and reservoir water saturation. Measuring the alternating current flowing parameters, we may compute the reservoir resistivity and/or reservoir water saturation more efficiently.

The present application provides structures and measurement methods for reservoir monitoring systems. The present application calculates the reservoir resistivity and/or reservoir water saturation by measuring the alternating current flowing parameters, such as phase velocity, group velocity, phase difference, amplitude decay, and time difference when the alternating current passes through the reservoir along the casing.

One aspect of the present application is an apparatus for monitoring reservoir parameters, such as resistivity and water saturation, comprising at least one surface control console, at least one power source to provide alternating current flowing through the reservoir along the casing, at least one transceivers installed outside casing, and at least one transceiver comprising a toroid coil antenna to measure the alternating current signal, and a processor configured for calculating at least one current flowing parameter based on the measured alternating current signal and/or for calculating at least one reservoir parameter based on at least one of the current flowing parameters while the alternating current passes through the reservoir along the casing, and:

- the alternating current signal is selected from the group consisting of amplitude, phase, real part, image part, and combinations thereof;
- the current flowing parameter is selected from the group consisting of phase velocity, group velocity, phase difference, amplitude decay, and time difference, and combinations thereof,
- the reservoir parameter is selected from the group consisting of reservoir resistivity, reservoir water saturation, and combinations thereof,
- transceiver has a power supply: rechargeable battery, and/or power cable connected with a surface control console,
- transceiver underground may transmit data to the surface control console,
- transceiver underground may obtain operation instructions issued by the surface control console.
- application is a device for monitoring reservoir parameters such as resistivity and water saturation.

Another aspect of the present application is method for monitoring reservoir parameters comprising:

- measuring alternating current signal passing through at least one transceiver along the casing;
- calculating by a processor at least one current flowing parameter along the casing based on the alternating current signal; and
- calculating reservoir resistivity and or water saturation using at least one current flowing parameter along the casing, in which:

- the alternating current signal is selected from the group consisting of amplitude, phase, real part, image part and combination thereof; and the current flowing parameter is selected from the group consisting of phase velocity, group velocity, phase difference, amplitude decay, and time difference, and combinations thereof; and the reservoir parameter is selected from the group consisting of resistivity, water saturation, and combinations thereof.

BRIEF DESCRIPTION OF THE DRAWINGS

One may obtain a better understanding of the present invention from the following detailed description of various embodiments. The attached drawings are only examples.

FIG. 1(*b*) shows an example of a transceiver used as a transmitter.

FIG. 1(*c*) shows an example of a transceiver used as a transmitter and a receiver at the same time.

FIG. 2(*b*) shows an example of a reservoir monitoring system in which a transceiver located underground is mounted on the outside of a casing, and another transceiver or current measuring circuit is installed on the cable connecting two wells to receive data transmitted from the transceiver located underground.

FIG. 3(*b*) shows an example of a reservoir monitoring system in which a transceiver located underground is mounted on the outside of a casing, another transceiver or current measuring circuit is installed on the cable connecting two wells, and a cable is used to connect the transceiver located underground and the surface control console.

FIG. 4(*b*) shows an example of a reservoir monitoring system in which two transceivers located underground are mounted on the outside of a casing and the third transceiver or a current measuring circuit is installed on the cable connecting two wells.

FIG. 5(*b*) shows an example of a reservoir monitoring system in which two transceivers located underground are mounted on the outside of a casing and the third transceiver or current measuring circuit is installed on the cable connecting two wells, and cables are used to connect the transceivers underground and the surface control console.

FIG. 6(*b*) shows an example of a reservoir monitoring system in which three transceivers located underground are mounted on the outside of a casing and the fourth transceiver or current measuring circuit is installed on the cable connecting two wells.

FIG. 7(*b*) shows an example of a reservoir monitoring system in which three transceivers located underground are mounted on the outside of a casing and the fourth transceiver or current measuring circuit is installed on the cable connecting two wells, and cables are used to connect the transceiver located underground and the surface control console.

DETAILED DESCRIPTION OF PREFERRED EMBODIMENTS

Figure 1A:
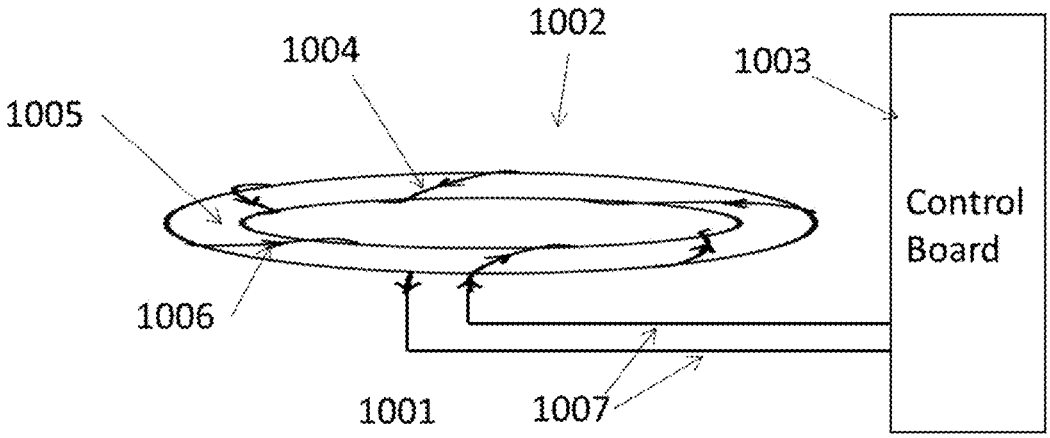
FIG. 1(*a*) shows an example of a transceiver used as a receiver.

The drawings and following detail description are just examples to understand the present invention which is susceptible to various modifications and alternating forms. It should be understood, however, that the drawings and detailed description thereof are not intended to limit the scope of the appended claims.

As used herein, "alternating current" refers to an electric current that periodically reverses direction and changes its magnitude continuously with time or electric current pulse.

As used herein, "current signal" or "alternating current signal" refers to real part, image part, phase and amplitude of current or voltage or electric field or magnetic field.

As used herein, "current flowing parameter" refers to phase velocity, group velocity, phase difference, amplitude decay, or time difference. "Phase velocity" is alternating current phase velocity, "group velocity" is alternating current group, "phase difference" is alternating current phase shift, and "amplitude decay" is alternating current amplitude decay while the alternating current passes through a section along the casing, and "time difference" is the time it takes for the alternating current to pass through a section along the casing.

As used herein, "power source" refers to electric power which may supply electricity to the transceiver and/or electrode, such as rechargeable battery and ground power equipment connected to the transceiver mounted underground and outside of a casing.

As used herein, "current measuring circuit" refers to a device for measuring the alternating current signal on the wire or on casing in frequency domain or time domain.

As used herein, "coil" refers to a loop made from a conductive wire, which may be regarded as a magnetic dipole.

As used herein, "electrode" refers to a solid electrical conductor or a group of conductors through which current flows into or out of a power source or other medium.

As used herein, "toroid coil" refers to a magnetic medium ring wound by a conductive wire.

As used herein, "electric gap" refers to a space filled with high resistivity material, such as an insulator, and connected with two high conductive materials, such as steel.

As used herein, "electric antenna" refers to toroid coil antenna, coil antenna, electrode, or electric gap.

As used herein, "transceiver" comprises at least one electric antenna used as transmitter and/or receiver, and/or pressure sensors used to measure the reservoir pressure, and/or temperature sensors used to measure a reservoir temperature, and/or acoustic sensors used to measure reservoir porosity, and/or neutron sensors used to measure reservoir density and/or water saturation, and/or control circuit, and/or power supply, and/or chips.

As used herein, "processor" refers to computer and/or chips installed in surface control console and/or transceiver that may be used for calculations.

As used herein, "reservoir parameter" refers to reservoir resistivity, reservoir water saturation, reservoir pressure, reservoir porosity, reservoir permeability and density.

As used herein, "surface control console" compromise computer, and/or ground power equipment, and/or control circuits, and/or control board.

Figure 1B:
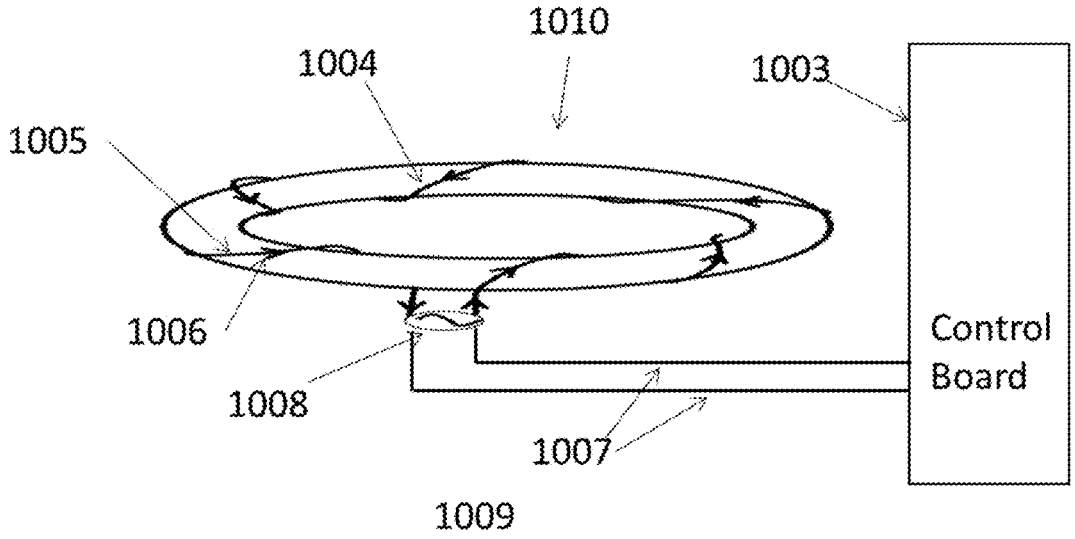
Figure 1C:
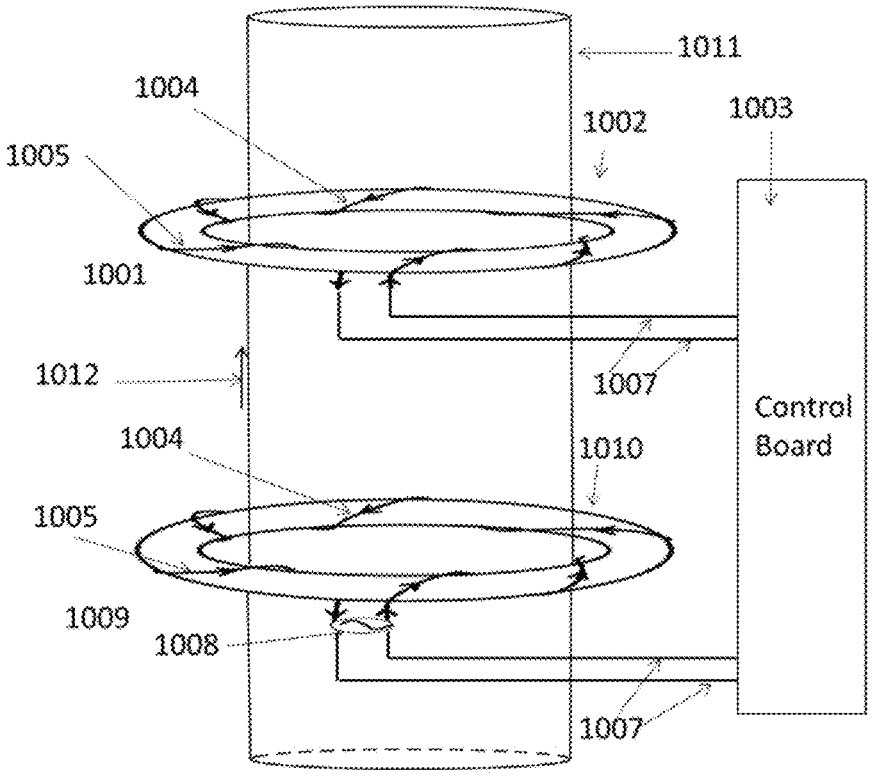

FIG. 1(*a*) shows an example of a transceiver 1001 used as a receiver of a reservoir monitoring system. The transceiver includes a toroid coil 1002 and control board 1003. The toroid coil 1002 is formed by winding a conductive wire 1004 on a magnetic material ring 1005 in a direction 1006. The toroid coil 1002 and control board 1003 are connected by a cable 1007. The control board 1003 includes circuits used for measuring voltage induced on the toroid coil 1002 while an alternating current pass through the toroid coil 1002, for receiving operation commands issued by another transceiver and/or by a surface control console, and for transmitting the measured current signals to other transceiver and/or to a surface control console, and/or chips used to process the measured current signals to obtain the current flowing parameter, such as phase velocity, group velocity, phase difference, amplitude decay, and time difference, and/or power system, such as battery, used to supply power for operation, etc.

FIG. 1(*b*) shows an example of a transceiver 1009 used as a transmitter of a reservoir monitoring system. If the control board receives operation commands issued by another transceiver or a surface control console, the control board 1003 will apply an alternating current 1008 added on the toroid coil 1010. While the transceiver is used as transmitter, the control board 1003 may receive operation commands issued by another transceiver/surface control console and generate an alternating current applied to the toroid coil 1010, and/or receive data measured by another transceiver used as a receiver, and/or transmit the measured data to other transceiver or a surface control console.

FIG. 1(*c*) shows an example of a transceiver used as a transmitter and a receiver at the same time. The transceiver includes two toroid coils 1002 and 1010 mounted outside of a conductive casing 1011 and connected with a control board 1003, respectively. If the control board 1003 receives operation commands issued by another transceiver or a surface control console, it will generate an alternating current 1008 applied to the toroid coil 1010 as a transmitter, and the toroid coil 1010 will emit an electromagnetic signal, such as electric field, which will induce an alternating current 1012 along a casing 1011. The induced alternating current 1012 will pass through the toroid coil 1002 and induce a voltage on the toroid coil 1002. The induced voltage reflects the induced alternating current 1012 parameters and is measured by measuring the circuit in control board 1003. The measured voltage will be processed by the chips in the control board 1003 to obtain the voltage parameters or the induced alternating current parameters, such as amplitude, phase, real part, image part, the induced current flowing speed, and time from toroid coil 1010 to toroid coil 1002. The parameters will be transmitted to another transceiver or a surface control console.

Note: FIG. 1(*c*) shows two toroid coils in a transceiver, one acting as a transmitter and the other acting as a receiver. In fact, a transceiver may include more than two toroid coils, and anyone may be a transmitter or a receiver.

Figure 2A:
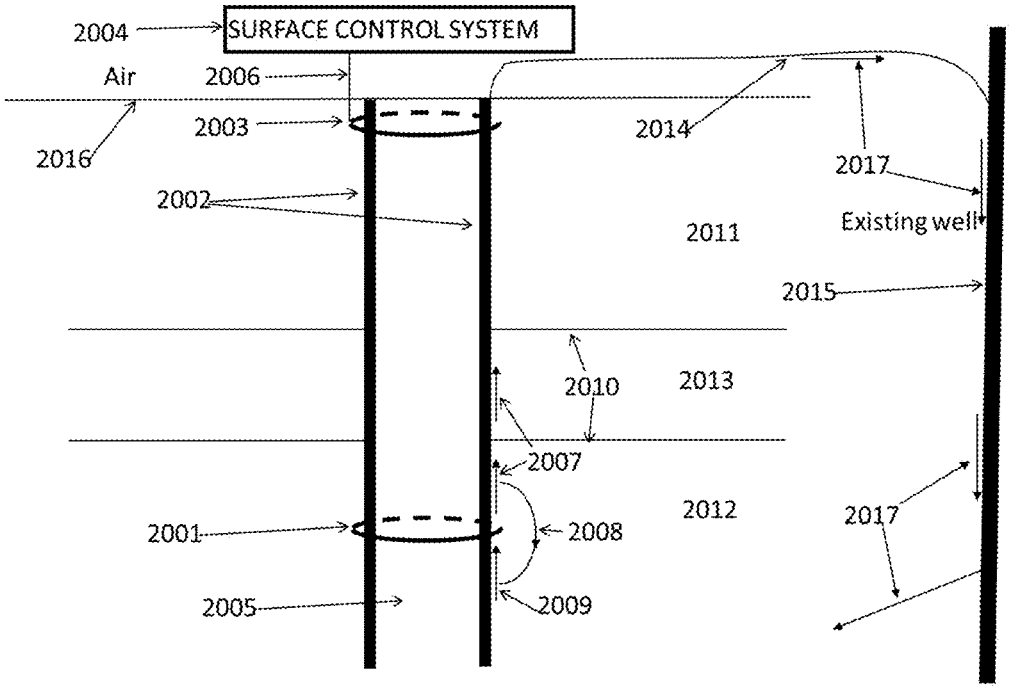
FIG. 2(*a*) shows an example of a reservoir monitoring system, where a transceiver located underground is mounted on the outside of a casing, and another transceiver is installed near the surface to receive data transmitted from the transceiver located underground.
Figure 2B:
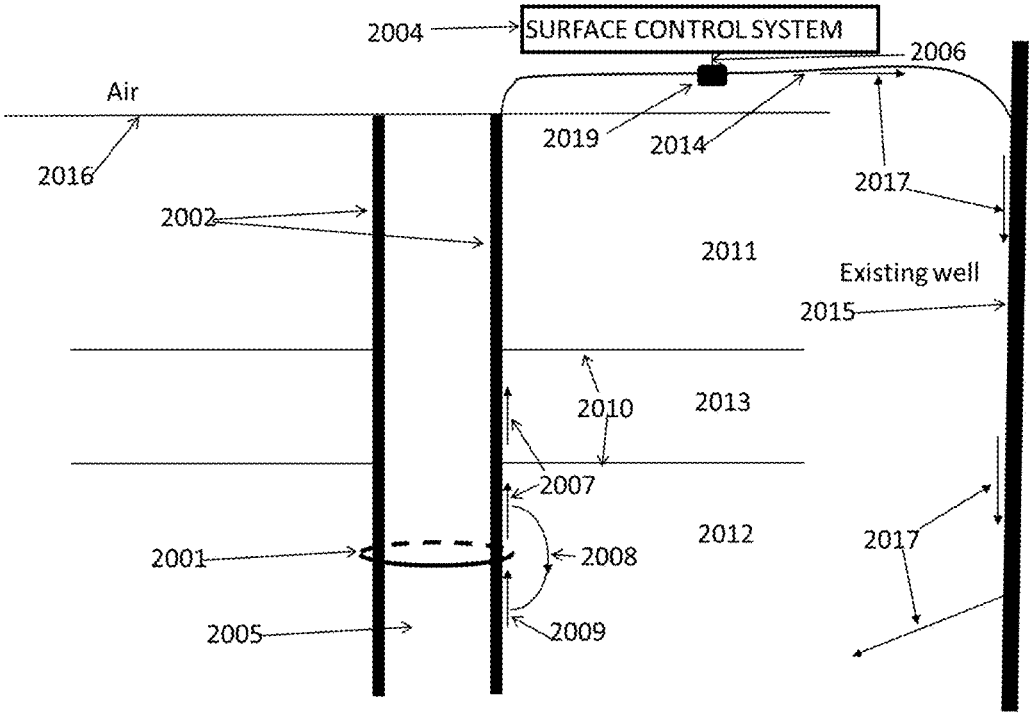

FIG. 2(*a*) shows an example of a reservoir monitoring system. A transceiver 2001 located underground is mounted on the outside casing 2002. A transceiver or current measuring circuit 2003 near the surface 2016 is mounted on outside of the casing 2002. The transceiver 2001 is used as a transmitter and the transceiver 2003 as a receiver. While the control board of the transceiver 2001 applies an alternating current to the toroid coil as a transmitter of the transceiver 2001, the alternating current will generate a magnetic current on the magnetic ring 1005 which will induce an alternating current 2007 flowing along the casing 2002. When the induced alternating current 2007 flows upward from one side of the toroid coil of the transceiver 2001, some current 2008 gradually leaks into the formation comprising the two surrounding layers 2011 and 2012 and the reservoir 2013 with the boundary 2010, and some current 2017 continually flows up to the surface 2016 and through the cable 2014 to an existing well 2015, the cable is used to connect the casing 2002 and the existing well 2015. The current 2017 flows downward along the existing well 2015 and into the formation. The current 2008 and the current 2017 flow to the other side of casing 2002. The current 2009 including current 2008 and current 2017 flows back to the other side of the toroid coil as a transmitter of the transceiver 2001. Then a current flowing loop from current 2007 to current 2008 and current 2017 to current 2009 is formed around the toroid coil as a transmitter of transceiver 2001. Since the current 2017 passes through the transceiver or current measuring circuit 2003, a voltage will be induced on the toroid coil of the transceiver or current measuring circuit 2003, and the induced voltage will be measured by the circuit of control board 2003 and transmitted to the surface control console 2004 through a cable 2006 connecting the transceiver 2003 and the surface control console 2004. Since the current 2007 flows along the casing in waves, it forms phase shift, amplitude decrease, current flowing speed, and current flowing time between transceivers 2001 and 2003. The reservoir monitoring system may record the current 2007 flowing time from transceiver 2001 to transceivers or current measuring circuit 2003, and then compute the current 2007 flowing speed between transceiver 2001 and transceivers 2003. Since the phase shift, amplitude decrease, current flowing speed, and current flowing time are related to the formation parameters, such as formation water saturation or formation resistivity, if some reservoir parameter such as water saturation or resistivity of the reservoir 2013 changes with time, the recorded current flow time and current flow velocity also change with time. Therefore, using the current flow time and current flow velocity recorded by the surface control console at different times, the reservoir monitoring system may monitor changes of the reservoir parameters in real time. Operation commands issued by the surface control console 2004 may be transmitted to the transceiver 2001 by the transceiver or current measuring circuit 2003. The surface control console 2004 includes a data acquisition circuit, a computer, and a power supply system. The computer is used to process the data received by the transceiver or current measuring circuit 2003.

FIG. 2(*b*) shows an example of a reservoir monitoring system. A transceiver or current measuring circuit 2019 is installed on cable 2014 for measuring signals of the current 2017 flowing through cable 2014. Using the measured current signals, the reservoir monitoring system may record the current 2007 flowing time from transceiver 2001 to transceivers or current measuring circuit 2003, and then compute the current 2007 flowing speed between the transceiver 2001 to the transceivers or current measuring circuit 2003. If parameters, such as water saturation or resistivity of the reservoir 2013, change with time, the recorded current flow time and current flow velocity also change with time. Therefore, using the current flow time and current flow velocity recorded at different times, the reservoir monitoring system may monitor changes of the reservoir parameters in real time. Operation commands issued by the surface control console 2004 may be transmitted to the transceiver 2001 by the transceivers or current measuring circuit 2003.

Using the measurements of the reservoir monitoring system shown in FIG. 2 at different times, it is possible to monitor changes of reservoir parameters. Since the transceiver 2001 of the reservoir monitoring systems shown in FIG. 2 has no external power, a rechargeable battery needs to be installed on the control board of the transceiver 2001. When the transceiver 2003 in FIG. 2(*a*) or the transceiver or current measuring circuit 2019 in FIG. 2(*b*) is powered, a current loop will be formed to charge the rechargeable battery in the transceiver 2001. The current loop includes the casing 2002, the cable 2014, the existing well 2015 and the formation between the casing 2002 and the existing well 2015.

Figure 3A:
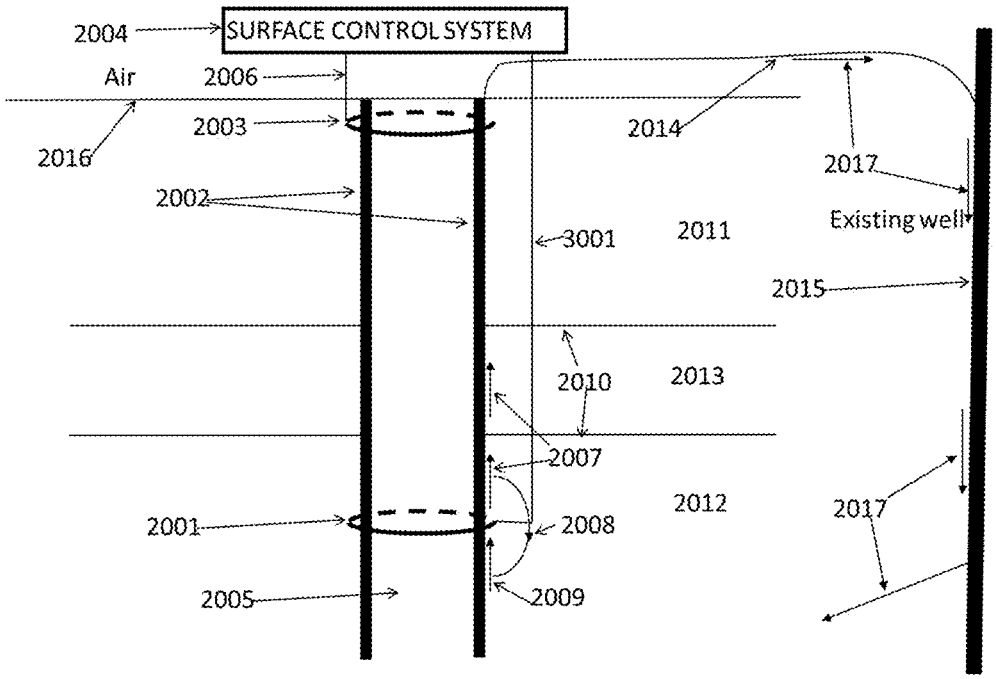
FIG. 3(*a*) shows an example of a reservoir monitoring system, where a transceiver located underground is mounted on the outside of a casing, another transceiver is installed near the surface to receive data transmitted from the subsurface, and a cable is used to connect the transceiver located underground and the surface control console.
Figure 3B:
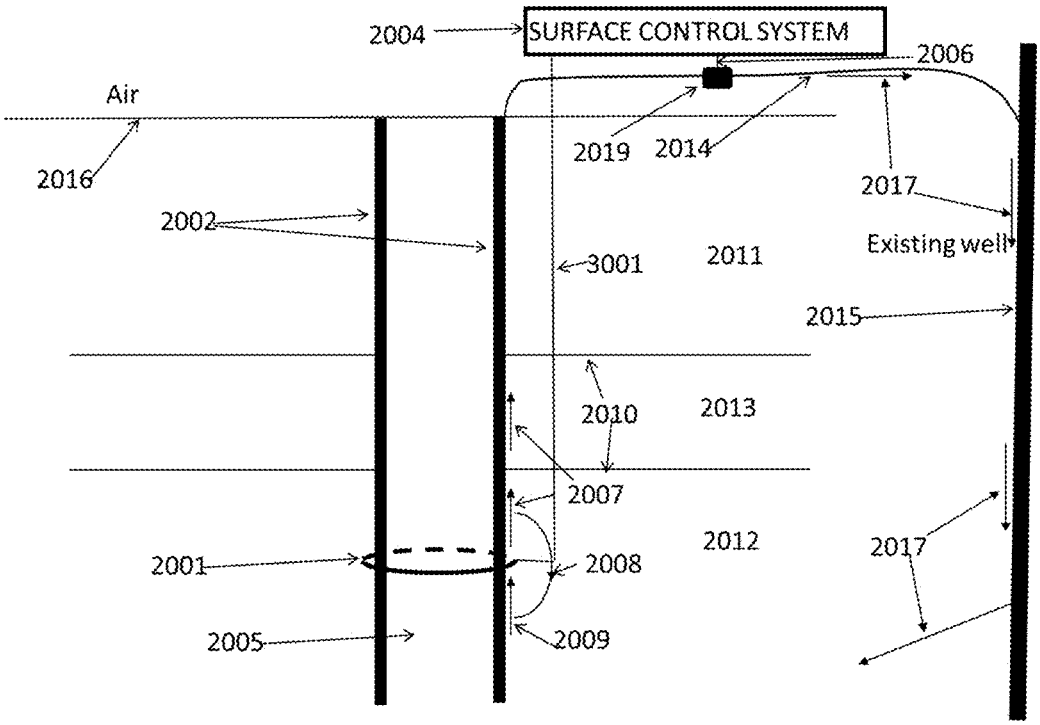

FIG. 3(*a*) shows an example of a reservoir monitoring system. Cable 3001 is used to connect transceiver 2001 to surface control console 2004, to apply power to the transceiver 2001, and to transmit data or commands between the transceiver 2001 and the surface control console 2004. Operation commands issued by the surface control console 2004 may be transmitted to the transceiver 2001 by the transceiver 2003 or the cable 3001.

FIG. 3(*b*) shows an example of a reservoir monitoring system. Cable 3001 is used to connect transceiver 2001 to surface control console 2004, to apply power to the transceiver 2001, and to transmit data or commands between the transceiver 2001 and the surface control console 2004. Operation commands issued by the surface control console 2004 may be transmitted to the transceiver 2001 by the transceiver or current measuring circuit 2019 or cable 3001.

Figure 4A:
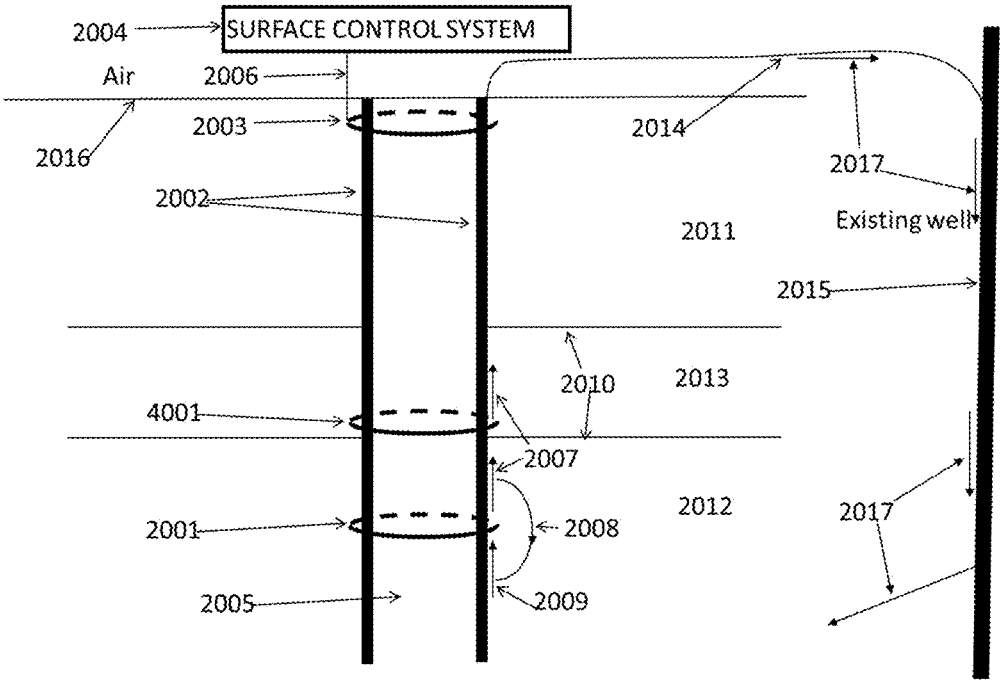
FIG. 4(*a*) shows an example of a reservoir monitoring system, where two transceivers located underground are mounted on the outside of a casing and the third transceiver is installed near the surface to receive data transmitted from the subsurface.
Figure 4B:
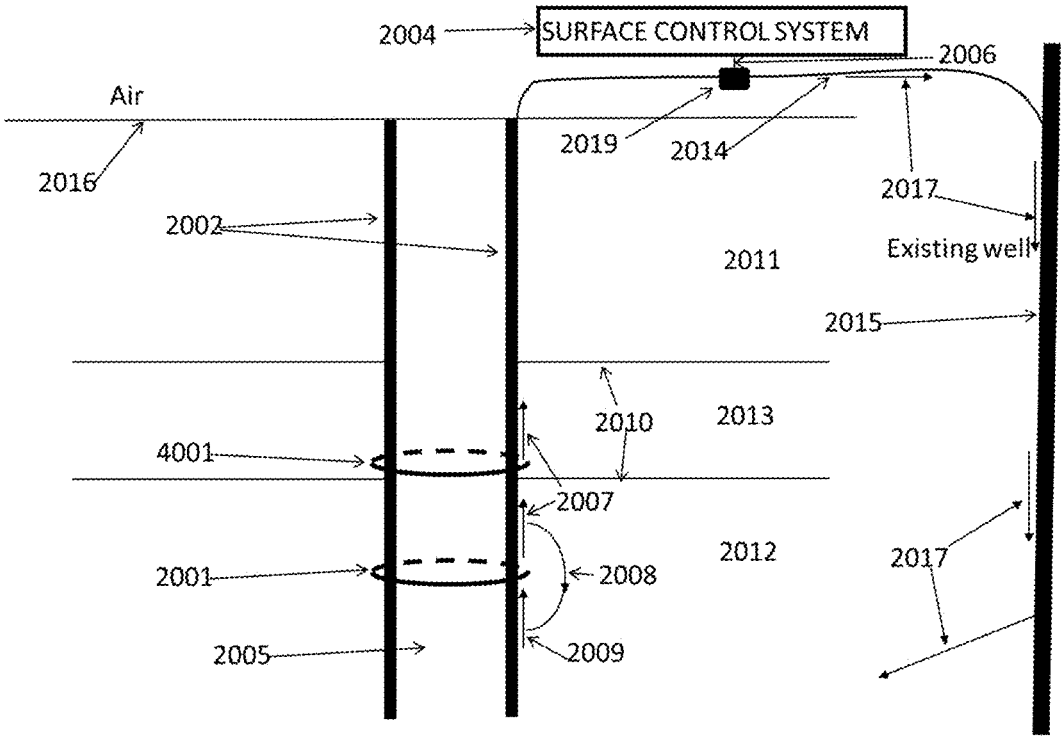

FIG. 4(*a*) shows an example of a reservoir monitoring system in which another underground transceiver 4001 is mounted on the outside casing 2002. In this embodiment, the transceiver 2001 having two toroid coils is used as a transmitter and a receiver at the same time respectively. The transceiver 4001 is used as a receiver. When the control board of transceiver 2001 applies an alternating current to the toroid coil 1010 as a transmitter, the alternating current will generate a magnetic current on the magnetic ring 1005, the magnetic current will induce an alternating current 2007 along the casing 2002. The induced alternating current 2007 will flow upward from one side of the toroid coil 1010 as a transmitter of the transceiver 2001, pass through the toroid coil 1002 as a receiver of the transceiver 2001 and the toroid coil as a receiver of the transceiver 4001, and then induce voltages on the receiver toroid coil 1002 of the transceiver 2001 and on the toroid coil as a receiver of the transceiver 4001. The induced voltage on the toroid coil as receiver of transceiver 2001 will be measured by the control board of the transceiver 2001 and named as $V_{2001}$. The induced voltage on the toroid coil of the transceiver 4001 will be measured by the control board of the transceiver 4001 and named as $V_{4001}$. The voltages may be expressed as $$V_{2001} = A_{2001}e^{i\theta_{2001}}, \tag{1}$$

$$V_{4001} = A_{4001}e^{i\theta_{4001}}\circ \tag{2}$$

The measured voltages $V_{2001}$ and $V_{4001}$ reflect the current 2007 signals passing through the toroid coil as receiver 1002 of the transceiver 2001 and the toroid coil as receiver of the transceiver 4001, and may be used to compute the current flowing parameters such as phase velocity, group velocity, phase difference, amplitude decay, and time difference between the toroid coil 1002 as receiver of the transceiver 2001 and the toroid coil as receiver of the transceiver 4001.

Calculating the ratio of $V_{2001}$ and $V_{4001}$ $$\text{Ratio} = \frac{V_2}{V_1}, \tag{4}$$

where $V_1=V_{2001}$, $V_2=V_{4001}$, and $V_1=A_1e^{i\theta_1}$, $V_2=A_2e^{i\theta_2}$. The phase difference Dphase, the amplitude ratio Aratio and amplitude attenuation Att when the induced alternating current passes through the toroid coil 1002 as receiver of the transceiver 2001 and the toroid coil as receiver of the transceiver 4001 are expressed as:

$$Dphase = \theta_2 - \theta_1 \tag{5}$$

$$Aratio = \left|\frac{A_2}{A_1}\right| \tag{6a}$$

$$Att = -20\log\left(\frac{A_2}{A_1}\right) \tag{6b}$$

The phase velocity of current 2007 flowing between the toroid coil 1002 as receiver of the transceiver 2001 and the toroid coil as receiver of the transceiver 4001 is $$V^p = 2\pi f\frac{L}{Dphase} \tag{7}$$

where f is the operation frequency, and L is the spacing between the toroid coil 1002 as receiver of the transceiver 2001 and the toroid coil as receiver of the transceiver 4001. The current flowing time between the toroid coil 1002 as receiver of the transceiver 2001 and the toroid coil as receiver of the transceiver 4001 may be expressed as $$\text{Time} = \frac{L}{V^p}. \tag{8}$$

Since the current flowing parameters are related to the formation parameters, such as formation resistivity and formation saturation, they will be used by the chips of the control boards of the transceivers 2001 and 4001 to calculate formation resistivity and formation water saturation. All data including the measured voltages, the computed current flowing parameters, formation resistivity and formation water saturation may be loaded into a low frequency current generated by one of the transceivers 2001, 4001, transmitted to the surface 2016 along casing 2002, received by the transceiver 2003 and recorded by the surface control console 2004. Operation commands issued by the surface control console 2004 may be transmitted to the transceivers 2001 and 4001 through the transceiver 2003. The surface control console 2004 includes data acquisition circuit, and/or a computer, and/or a power supply system. The computer is used to process the data recorded by the transceiver 2003. The transceiver 2003 may also be placed on the existing well 2015.

FIG. 4(*b*) shows an example of a reservoir monitoring system. All data including the measured voltages, the computed current flowing parameters, formation resistivity and formation water saturation may be loaded into a low frequency current generated by one of the transceivers 2001 and 4001, transmitted to the surface 2016 along casing 2002, received by the transceiver or current measuring circuit 2019 and recorded by the surface control console 2004. Operation commands issued by the surface control console 2004 may be transmitted to the transceivers 2001, 4001 through the transceiver or current measuring circuit 2019.

Using the measurements of the reservoir monitoring system shown in FIG. 4 at different times, it is possible to monitor changes of reservoir parameters. Since the transceiver 4001 of the reservoir monitoring systems shown in FIG. 4 has no external power, rechargeable battery needs to be installed on the control board of the transceiver 4001. When the transceiver 2003 in FIG. 4(*a*), or the transceiver or current measuring circuit 2019 in FIG. 4(*b*) is powered, a current loop will be formed to charge the rechargeable battery in the transceiver 4001. The current loop includes the casing 2002, the cable 2014, the existing well 2015 and the formation between the casing 2002 and the existing well 2015.

Figure 5A:
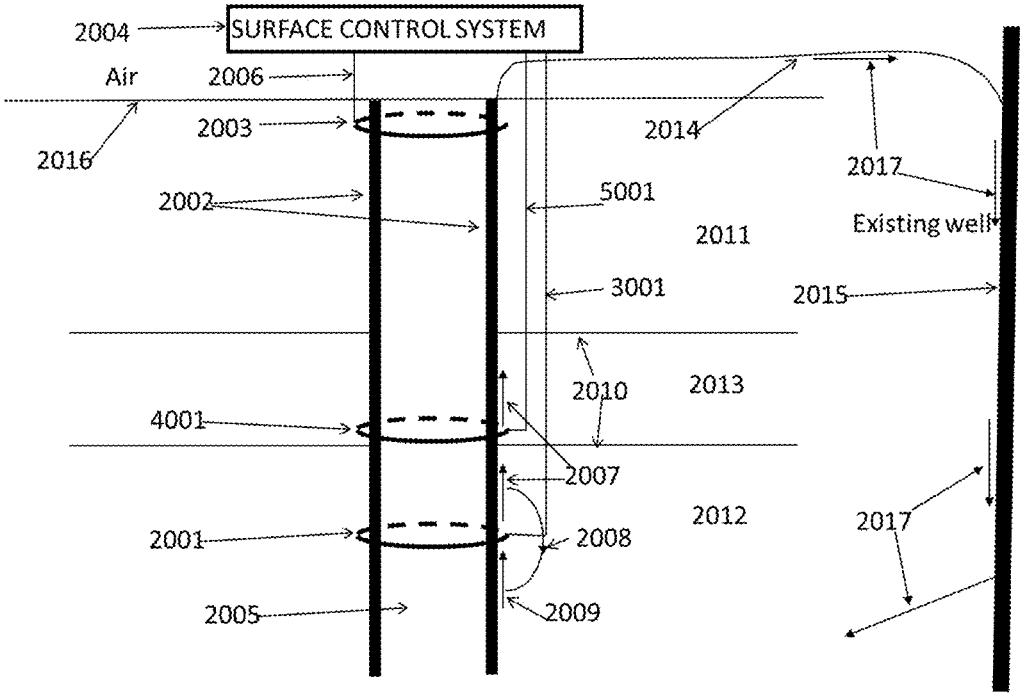
FIG. 5(*a*) shows an example of a reservoir monitoring system, where two transceivers underground are mounted on the outside casing and the third transceiver is installed near the surface to receive data transmitted from the subsurface, and cables are used to connect the transceivers underground and the surface control console.
Figure 5B:
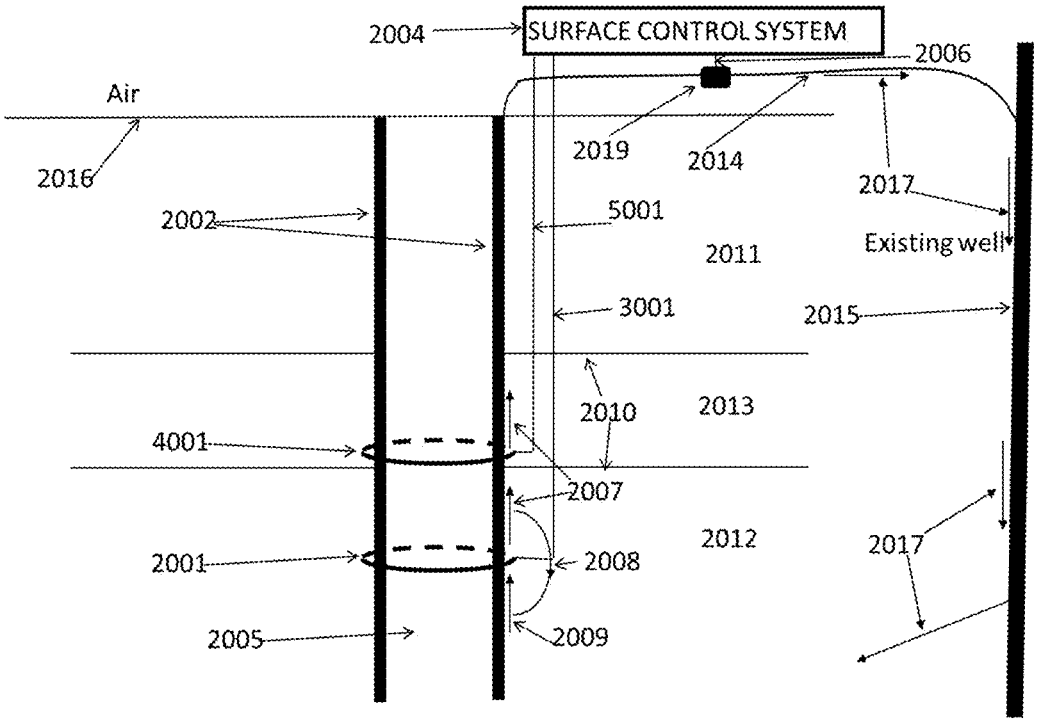

FIG. 5(*a*) shows an example of a reservoir monitoring system. Cable 5001 is used to connect transceiver 4001 to surface control console 2004, to apply power to the transceiver 4001, and to transmit data between transceiver 4001 and surface control console 2004. Operation commands issued by the surface control console 2004 may be transmitted to the transceiver 4001 through the transceiver or current measuring circuit 2003 or cable 5001.

FIG. 5(*b*) shows an example of a reservoir monitoring system. Cable 5001 is used to connect transceiver 4001 to surface control console 2004, to apply power to the transceiver 4001, and to transmit data between transceiver 4001 and surface control console 2004. Operation commands issued by the surface control console 2004 may be transmitted to the transceiver 4001 by the transceiver or current measuring circuit 2019 or the cable 5001.

Note: FIG. 4 and FIG. 5 show the transceiver with a toroid coil as a receiver to measure the voltage induced on the toroid coil. In fact, a transceiver may include electrodes mounted on the casing to measure a voltage between the electrodes. The voltage between the electrodes may be used to compute the alternating current flowing parameters, for example, the phase of the voltage is the phase difference of an alternating current flowing between the electrodes. So, the voltages between the electrodes may be used to evaluate reservoir parameters, such as reservoir resistivity and water saturation FIG. 6(*a*) shows an example of a reservoir monitoring system. In this embodiment, one toroid coil of transceiver 2001 is used as transmitter, two toroid coils of transceivers 4001 and 6001 are used as receivers. While the control board of the transceiver 2001 applies an alternating current on the toroid coil as receiver of the transceiver 2001, the alternating current generates a magnetic current on the magnetic ring 1005 which induces an alternating current 2007 along the casing 2002. The induced alternating current 2007 flows upward from one side of the toroid coil as transmitter of the transceiver 2001, passes the toroid coil as receiver of the transceiver 4001 and the toroid coil as receiver of the transceiver 6001, and then induce voltages on the toroid coil as receiver of the transceiver 4001 and on the toroid coil as receiver of the transceiver 6001. The induced voltage on the toroid coil as receiver of the transceiver 6001 will be measured by the control board of the transceiver 6001 and named as $V_{6001}$. The voltage $V_{6001}$ may be expressed as $$V_{6001} = A_{6001}e^{i\theta_{6001}}. \tag{9}$$

The measured voltages $V_{4001}$ and $V_{6001}$ reflect the signal of the current 2007 passing through the transceivers 4001 and 6001, respectively. Let $V_1=V_{4001}$, $V_2=V_{6001}$, using the formulae (4), (5), (6), (7), (8), the current flowing parameters between the transceivers 4001 and 6001 may be calculated. The current flowing parameters are related to the reservoir parameters, such as reservoir resistivity and reservoir water saturation, and are used by the control board chips of the transceivers 4001 and 6001 to compute the reservoir parameters. All data including the measured voltages, the computed current flowing parameters and the reservoir parameters may be loaded into a low frequency current generated by one of the transceivers 2001, 4001 and 6001, transmitted to the surface along casing 2002, received by the transceiver 2003 and recorded by the surface control console 2004. Operation commands issued by the surface control console 2004 may be transmitted to the transceivers 2001, 4001 and 6001 through the transceiver 2003.

Figure 6A:
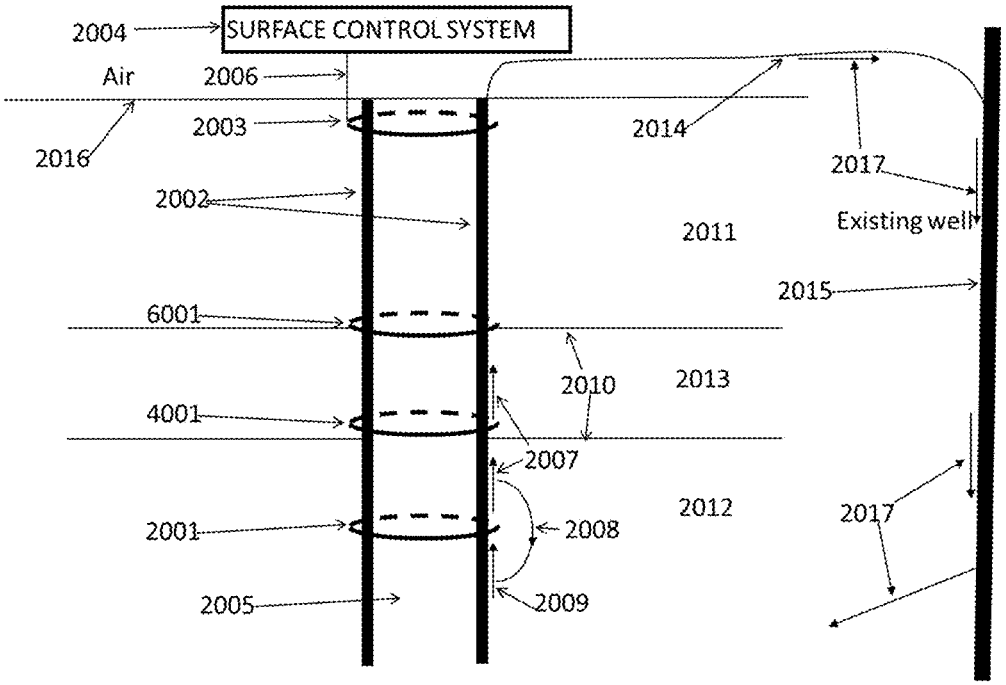
FIG. 6(*a*) shows an example of a reservoir monitoring system, where three transceivers underground are mounted on the outside casing and the fourth transceiver is installed near the surface to receive data transmitted from the subsurface.
Figure 6B:
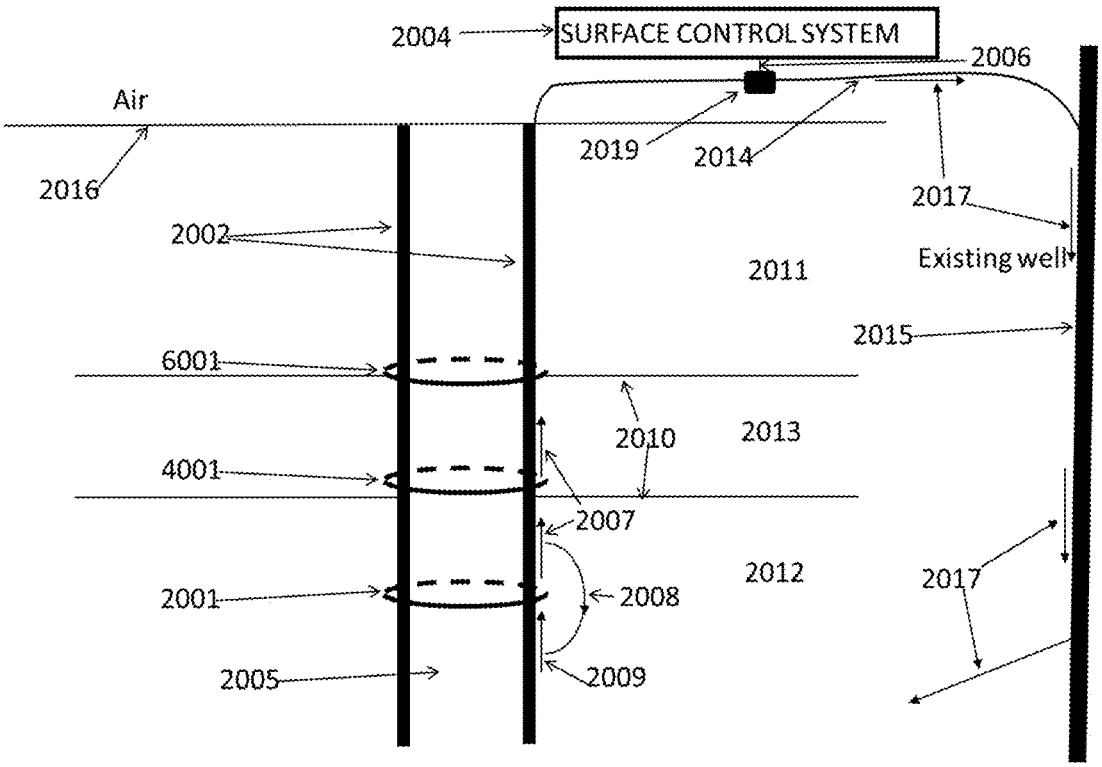

FIG. 6(*b*) shows an example of a reservoir monitoring system. All data including the measured voltages, the computed current flowing parameters and the reservoir parameters may be loaded into a low frequency current generated by one of the transceivers 2001, 4001 and 6001, transmitted to the surface along casing 2002, received by the transceiver or a current measuring circuit 2019 and recorded by the surface control console 2004. Operation commands issued by the surface control console 2004 may be transmitted to the transceivers 2001, 4001 and 6001 through the transceiver 2019.

Using the measurements of the reservoir monitoring system shown in FIG. 5 at different times, it is possible to monitor changes of reservoir parameters. Since the transceiver 6001 of the reservoir monitoring systems shown in FIG. 6 has no external power, rechargeable battery needs to be installed on the control board of the transceiver 6001. When the transceiver 2003 in FIG. 6(*a*), or the transceiver or current measuring circuit 2019 in FIG. 6(*b*) is powered, a current loop will be formed to charge the rechargeable battery in the transceiver 6001. The current loop includes the casing 2002, the cable 2014, the existing well 2015 and the formation between the casing 2002 and the existing well 2015.

Figure 7A:
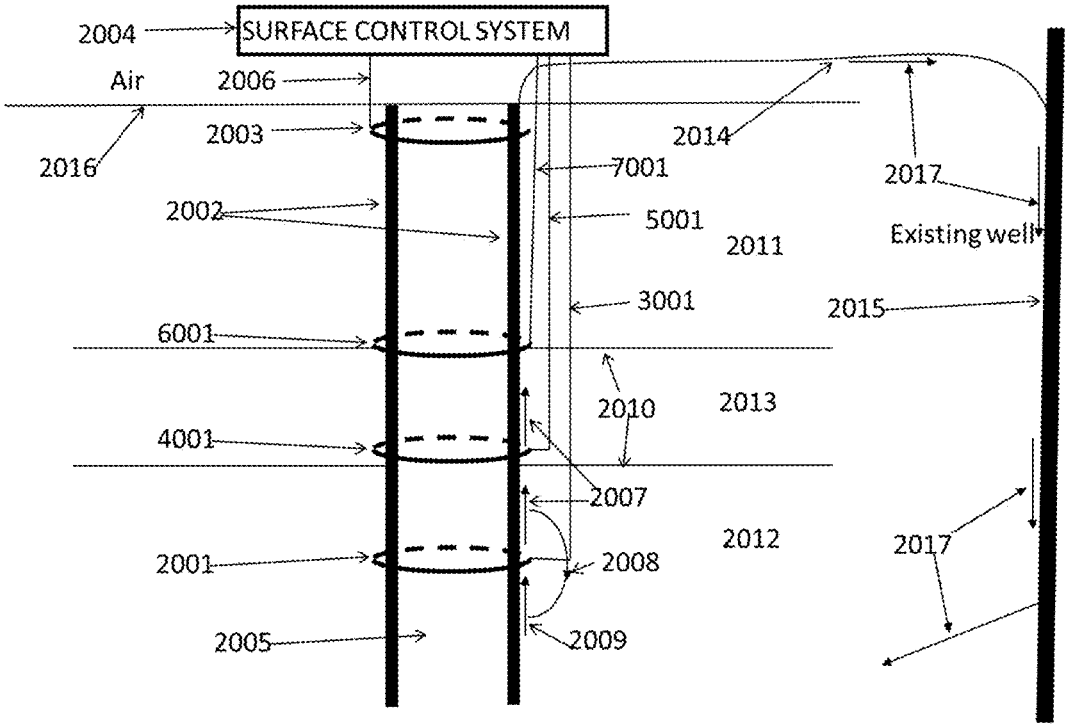
FIG. 7(*a*) shows an example of a reservoir monitoring system, where three transceivers located underground are mounted on the outside of a casing and the fourth transceiver is installed near the surface to receive data transmitted from the subsurface, and cables are used to connect the transceivers located underground and the surface control console.
Figure 7B:
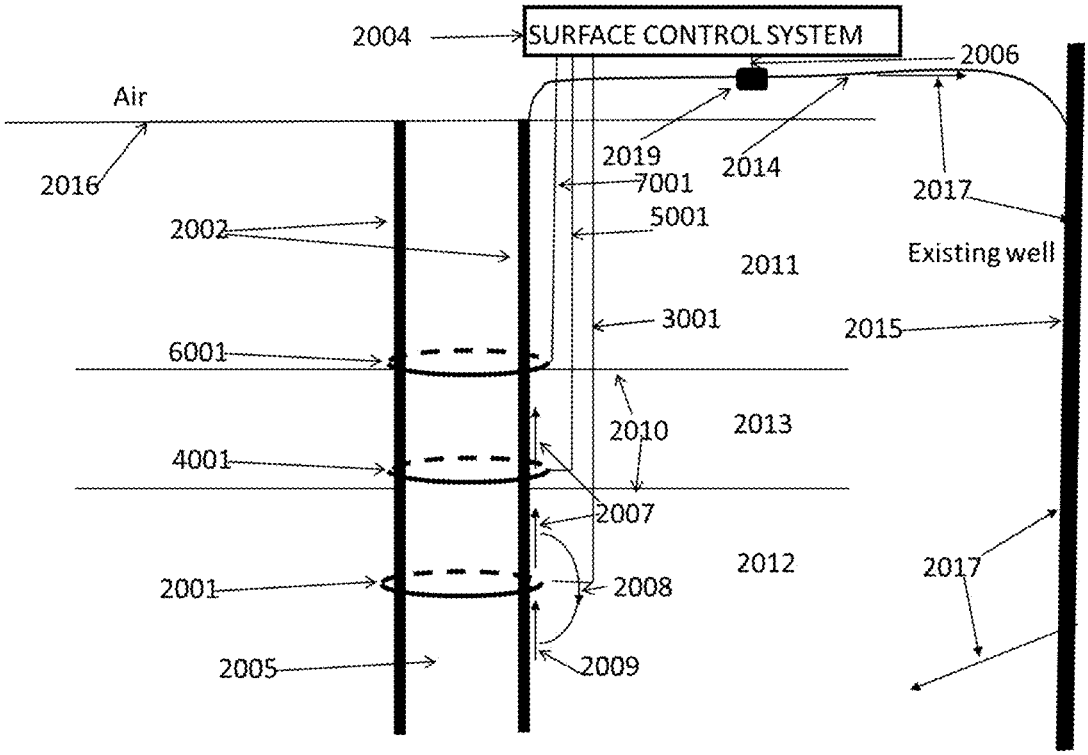

FIG. 7(*a*) shows an example of a reservoir monitoring system. Cable 7001 is used to connect transceiver 6001 to surface control console 2004, to apply power to the transceiver 6001, and to transmit data between transceiver 4001 and surface control console 2004. Operation commands issued by the surface control console 2004 may be transmitted to the transceiver 6001 by the transceiver 2003 or the cable 7001.

FIG. 7(*b*) shows an example of a reservoir monitoring system. Cable 7001 is used to connect transceiver 6001 to surface control console 2004, to apply power to the transceiver 6001, and to transmit data between transceiver 6001 and surface control console 2004. Operation commands issued by the surface control console 2004 may be transmitted to the transceiver 6001 by the transceiver or current measuring circuit 2019 or the cable 7001.

Note: FIG. 7 only shows two examples of reservoir monitoring systems in which the transceivers are mounted outside of the casing, and electric antennae in the transceivers is a toroid coil. Actually, the electric antennae in the transceivers may be electrodes and installed inside of the casing. Cables 3001, 5001 and 7001 may be partly or entirely placed inside of casing.

Figure 8:
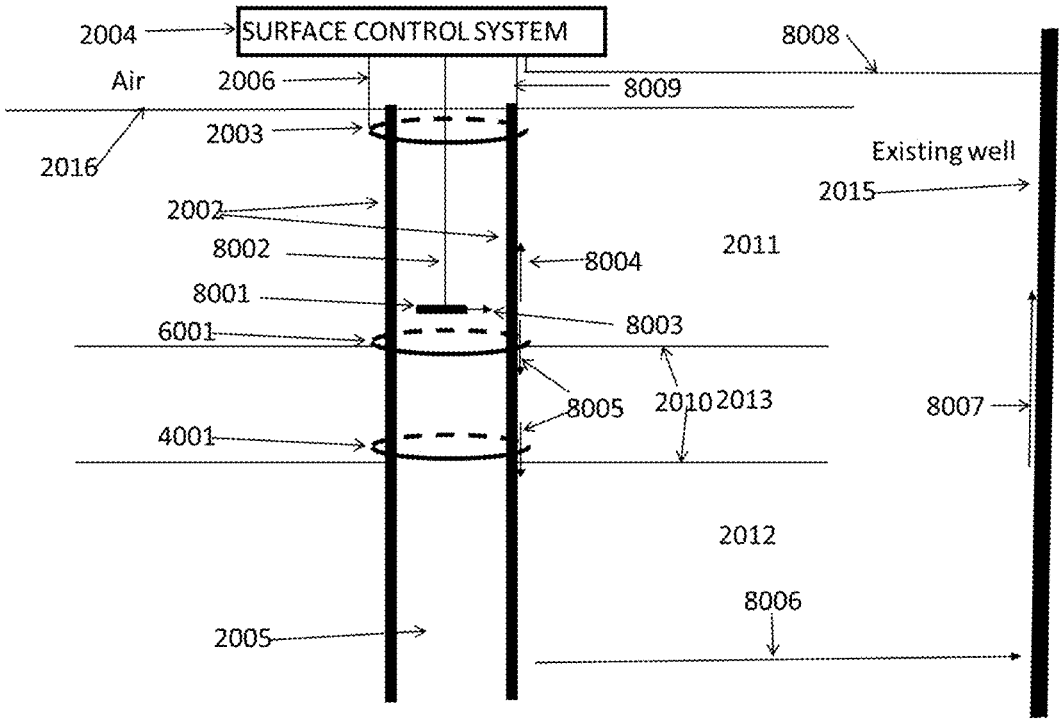
FIG. 8 shows an example of a reservoir monitoring system, where two transceivers located underground are mounted on the outside of a casing, an electrode is placed inside of a borehole, and a transceiver is installed near the surface to receive data transmitted from the subsurface.

Note: FIG. 6 and FIG. 7 show the transceiver with a toroid coil as a receiver to measure the voltage induced on the toroid coil. In fact, a transceiver may include electrodes to measure a voltage between the electrodes. The voltages between the electrodes may be used to evaluate reservoir parameters, such as reservoir resistivity and water saturation FIG. 8 shows an example of a reservoir monitoring system. An electrode 8001 is placed inside of the borehole 2005 and is connected to the surface control console 2004 by a cable 8002. While surface control console applies an alternating current 8003 to electrode 8001, the alternating current 8003 flows to the casing 2002, and a part of the current 8004 flows upward to the surface along the casing 2002, and a part of current 8005 flows downward along the casing and gradually leaks into the formation around the casing. A part of the leaked current 8006 flows to the existing well 2015 and upward along the existing well 2015 to the surface. While the current 8007 flows to the surface, it goes through a cable 8008 to the surface control console. When the current 8004 flows up to the surface, it passes through a cable 8009 to the surface control console. The cables 8008, 8009 may be attached together and then connected to the surface control console. The current 8005 passes through the transceivers 4001 and 6001 and then induce voltages on the toroid coils as receiver of the transceivers 4001 and 6001. The induced voltages will be measured by the control boards of transceivers 4001 and 6001, and named as V4001 and V6001. The measured voltages V4001 and V6001 respectively reflect the signals of the current 8004 passing through the transceivers 4001 and 6001, which may be used to compute the current flowing parameters between the toroid coils of the transceivers 4001 and 6001. The current flowing parameters are related to the reservoir parameters are used by the chips of the control boards of the transceivers 4001 and 6001 to compute the reservoir parameters. All data including the measured voltages, the current signals, the computed current flowing parameters and the reservoir parameters may be loaded into a low frequency current generated by one of the transceivers 4001, 6001, transmitted to the surface along casing 2002, received by the transceiver 2003 and recorded by the surface control console 2004. Operation commands issued by the surface control console 2004 may be transmitted to the transceivers 4001 and 6001 through the transceiver 2003 or cable 8002.

Using the measurements of the reservoir monitoring system shown in FIG. 8 at different times, it is possible to monitor changes of reservoir parameters.

Note: FIG. 8 only shows an example of reservoir monitoring systems in which the transceivers are mounted outside of the casing, and electric antennae in the transceivers is a toroid coil. Actually, the electric antennae in the transceivers may be electrodes used to measure voltages between electrodes, and the transceivers may be installed inside of the casing.

Note The antennae shown in FIGS. 4 to 8 are electric antennae. In fact, the transceiver may include acoustic and/or neutron sensors for measuring reservoir porosity, water saturation, permeability and density.

Figure 9:
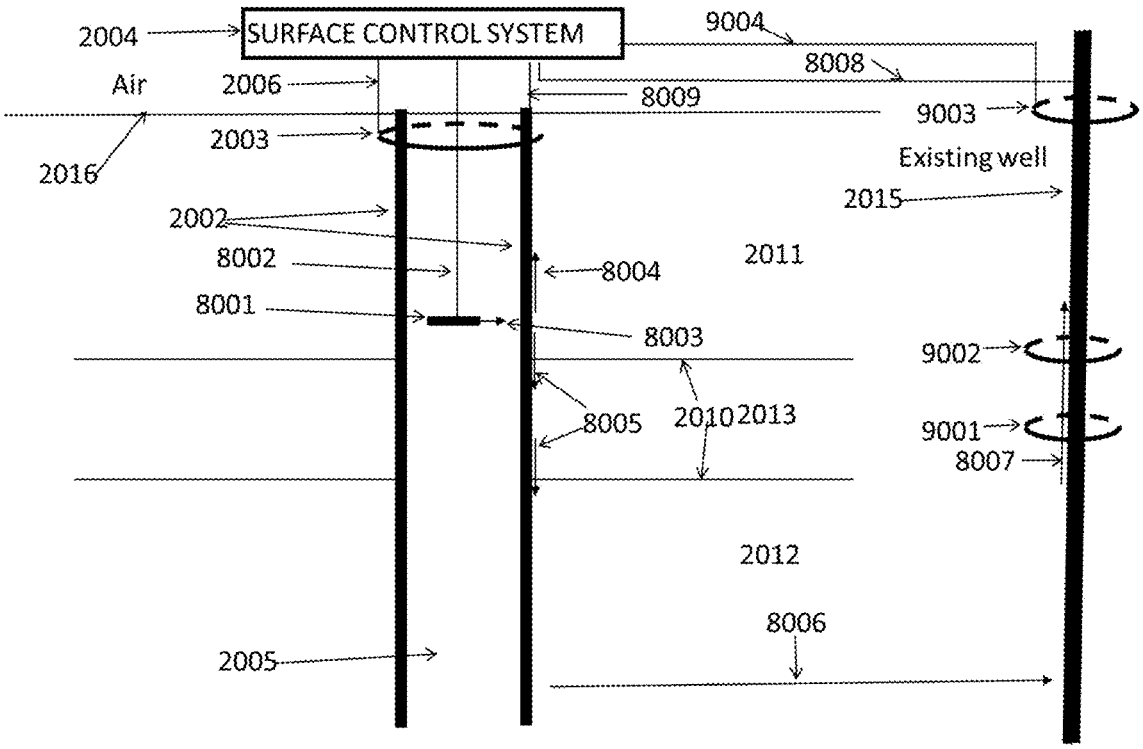
FIG. 9 shows an example of a reservoir monitoring system, where an electrode is placed inside of a borehole of a well, two transceivers located underground are mounted on outside casing of another well, and a transceiver or current measuring circuit is installed on the cable connecting two wells.

FIG. 9 shows an example of a reservoir monitoring system. The underground transceivers 9001 and 9002 are installed outside casing of the existing well 2015, and transceiver 9003 is installed outside casing of the existing well 2015 near the surface. When the current 8007 passes through the transceivers 9001 and 9002 along the existing well 2015, voltages will be induced on the toroid coils as receivers of the transceivers 9001 and 9002. The induced voltages are measured by the circuit of control boards of transceiver 9001 and 9002, named as V9001 and V9002, respectively, and expressed as $$V_{9001} = A_{9001}e^{i\theta_{9001}}. \tag{10}$$

$$V_{9002} = A_{9002}e^{i\theta_{9002}}. \tag{11}$$

Let $V_1=V_{9001}$, $V_2=V_{9002}$, using the formulae (4), (5), (6), (7), (8), the current flowing parameters between the transceivers 9001 and 9002 may be calculated by the chips of control boards of transceivers 9001 and 9002. All data including the measured voltages, the current signals, the computed current flowing parameters, and the reservoir parameters may be loaded into a low-frequency current generated by one of the transceivers 9001 and 9002, transmitted to the surface along the existing well 2015, received by the transceiver 9003 and recorded by the surface control console 2004. Operation commands issued by the surface control console 2004 may be transmitted to the transceivers 9001, 9002 and 9003 through cable 8002 and/or electrode 8001.

Using the measurements of the reservoir monitoring system shown in FIG. 9 at different times, it is possible to monitor changes of reservoir parameters. Since the transceiver 9001 and 9002 of the reservoir monitoring systems shown in FIG. 9 has no external power, a rechargeable battery needs to be installed on the control boards of the transceivers 9001 and 9002. When electrode 8001 in FIG. 9 is powered, a current loop will be formed to charge the rechargeable battery in the transceivers 9001 and 9002. The current loop includes cable 8002, casing 2002, cable 8008, existing well 2015, and the formation between casing 2002 and existing well 2015. Actually, transceivers 9001 and 9002 may be powered by the surface control console 2004 through cables connecting the transceivers 9001 and 9002 to the surface control console 2004.

Note: FIG. 9 shows to measure the induced voltage on the toroid coils as reservoirs of transceivers. In fact, a transceiver may have electrodes used to measure the voltages between electrodes. The measured voltages may be used to evaluate the reservoir parameters.

Figure 10:
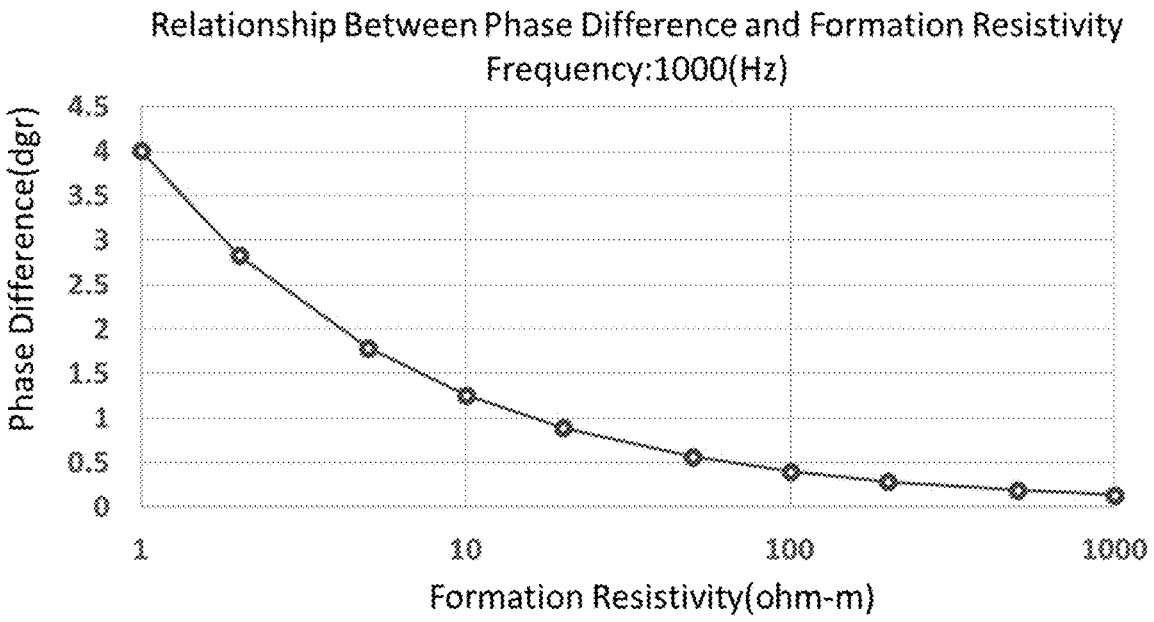
FIG. 10 shows the relationship between the formation resistivity and the phase difference of alternating current flowing between transceivers.

FIG. 10 shows the relationship between the formation resistivity and the phase difference of the alternating current flowing between the toroid coils as receivers of transceivers, such as between the toroid coil 1002 as reservoir of the transceiver 2001 and the toroid coil as reservoir of transceiver 4001, and between the toroid coil as reservoir of transceiver 4001 and the toroid coil as reservoir of transceiver 6001, and between the toroid coil as reservoir of transceiver 9001 and the toroid coil as reservoir of transceiver 9002. The calculation conditions of FIG. 10 are that the alternating current frequency is 1000 (Hertz), the space between two toroid coils is 1 (meter), the inner casing resistivity is 1 (ohm-meter), the casing thickness is 7 (mm), and the casing resistivity is 0.000001 (ohm-m). The figure shows that there is a good one-to-one relationship between the phase difference and the formation resistivity. After the phase difference between the toroid coils as receivers of transceivers is computed, the relationship may be used to calculate the reservoir resistivity and then to compute reservoir water saturation.

Note: The parameters used in the calculation of FIG. 10 are only to show the relationship between the phase difference and the formation resistivity, not to define the operating conditions of the reservoir monitoring system. The system may have any operating frequency and size.

Figure 11:
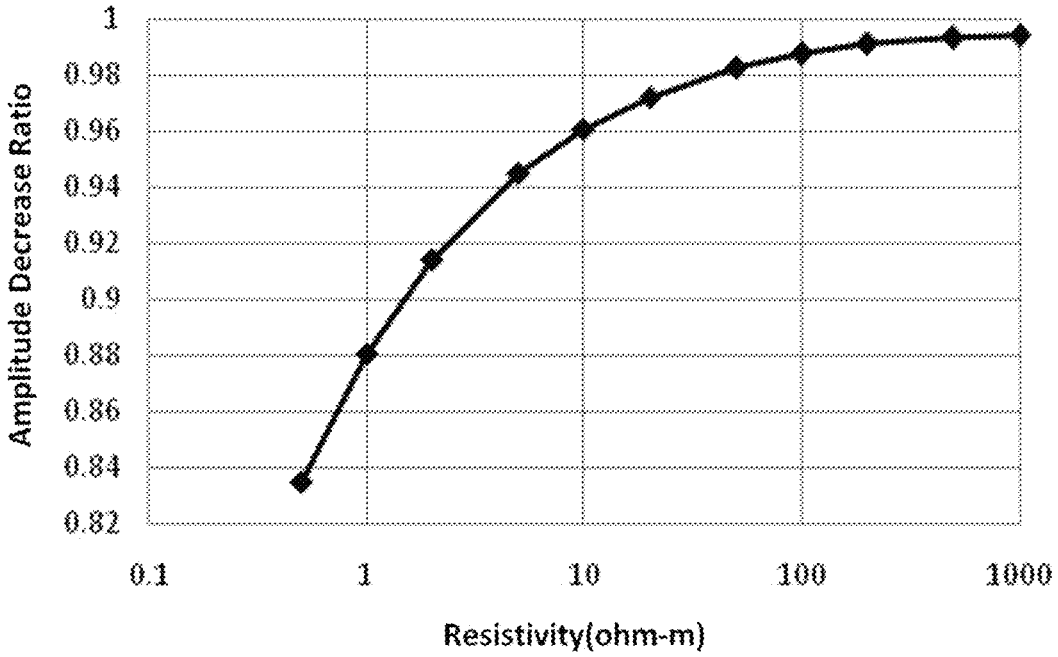
FIG. 11 shows the relationship between the formation resistivity and the amplitude ratio of alternating current flowing between transceivers.

FIG. 11 shows the relationship between the formation resistivity and the ratio of alternating current amplitude at two toroid coils as reservoirs. The calculation conditions are same as that used to compute FIG. 10. The figure shows that there is a good one-to-one relationship between current amplitude ratio and formation resistivity. After the current amplitude ratio between the toroid coils is computed, the relationship shown in FIG. 11 may be used to calculate the reservoir resistivity and then to compute reservoir water saturation.

Note: The parameters used in the calculation of FIG. 11 are only to show the relationship between the between current amplitude ratio and the formation resistivity, not to define the operating conditions of the reservoir monitoring system. The system may have any operating frequency and size.

Figure 12:
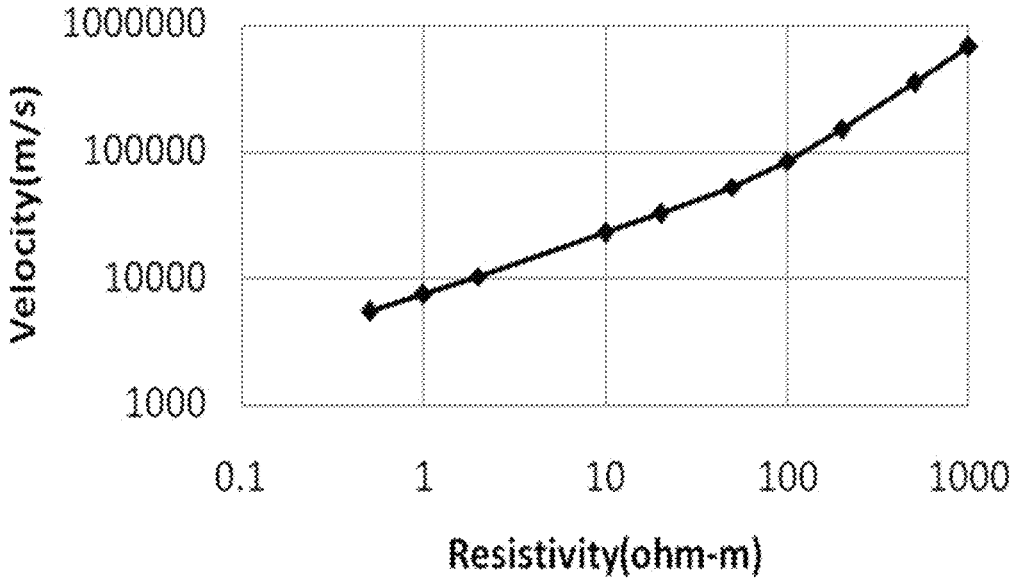
FIG. 12 shows the relationship between formation resistivity and phase velocity of alternating current flowing between transceivers.

FIG. 12 shows the relationship between the formation resistivity and the phase velocity while an alternating current flows through two toroid coils as reservoirs. The calculation conditions are same as that used to compute FIG. 10. The figure shows that there is a very good one-to-one relationship between the phase velocity and the formation resistivity. After the phase velocity between the toroid coils is computed, the relationship shown in FIG. 12 may be used to calculate the reservoir resistivity and then to compute reservoir water saturation.

Note: The parameters used in the calculation of FIG. 12 are only to show the relationship between the phase velocity and the formation resistivity, not to define the operating conditions of the reservoir monitoring system. The system may have any operating frequency and size. Group velocity may also be used to calculate the reservoir resistivity and then to compute reservoir water saturation.

In one embodiment, the present invention provides a reservoir monitoring system. The reservoir monitoring system includes at least one transceiver. The transceivers each has rechargeable battery.

In one embodiment, the present invention provides a reservoir monitoring system. The reservoir monitoring system includes at least one transceiver. Each transceiver is connected to the surface control console with a cable. The cables are used to supply power to the transceivers, to transmit data or messages between the transceiver and the surface control console.

In one embodiment, the present invention provides a reservoir monitoring system. The reservoir monitoring system includes a conductive cable connecting the casings of two wells.

In one embodiment, the present invention provides a reservoir monitoring system. The reservoir monitoring system includes one transceiver mounted outside of a casing near the surface. The transceiver is connected to the surface control console. The transceiver acts as a receiver to receive the message sent by underground transceiver or electrode.

In one embodiment, the present invention provides a reservoir monitoring system. The reservoir monitoring system includes a conductive cable connecting two wells and one transceiver or current measuring circuit mounted on the cable. The transceiver or current measuring circuit is connected to the surface control console and acts as a receiver to receive the signals transmitted by underground transceiver or electrode.

In one embodiment, the present invention provides a reservoir monitoring system. The reservoir monitoring system includes one transceiver which has three toroid coils: one is used as transmitter, the others as receivers.

In one embodiment, the present invention provides a reservoir monitoring system. The reservoir monitoring system includes two underground transceivers mounted outside of the casing. One of two underground transceivers has two toroid coils, one used as a transmitter and the other as a receiver. Another underground transceiver has a toroid coil acting as a reservoir. When an alternation current power is applied to the toroid coil acting as a transmitter, it induces an alternation current flowing along the casing and passing through the two toroid coils acting as receivers. The induced alternating current signals are measured by the transceivers.

In one embodiment, the present invention provides a reservoir monitoring system. The reservoir monitoring system includes two underground transceivers mounted outside of the casing. One of the two underground transceivers has two toroid coils, one used as a transmitter and the other as a receiver. Another underground transceiver has a toroid coil acting as a reservoir. When an alternation current power is applied to the toroid coil acting as a transmitter, it induces an alternation current flowing along the casing and passing through the two toroid coils acting as receivers. The induced alternating current signals are measured by the transceivers. The measured current signals are loaded into a low-frequency current generated by one of the transceivers, then transmitted to the surface through the low-frequency current and received by a surface control console. From the current signals, current flowing parameters between the two toroid coils as receivers of transceivers may be computed by the computer of the surface control console. The current flowing parameters are used to calculate reservoir resistivity and water saturation to monitor a reservoir.

In one embodiment, the present invention provides a reservoir monitoring system. The reservoir monitoring system includes two underground transceivers mounted outside of the casing. One of the two underground transceivers has two toroid coils, one used as a transmitter and the other as a receiver. Another underground transceiver has a toroid coil acting as a reservoir. When an alternation current power is applied to the toroid coil acting as a transmitter, it induces an alternation current flowing along the casing and passing through the two toroid coils acting as receivers. The induced alternating current signals are measured by the transceivers. The measured current signals are used by the chip of the transceiver to computed current flowing parameters between the two toroid coils as receivers of transceivers. The current signals and current flowing parameters are loaded into a low frequency current generated by one of the transceivers, transmitted to the surface, received by surface control console, and then used to calculate reservoir parameters.

In one embodiment, the present invention provides a reservoir monitoring system. The reservoir monitoring system includes two underground transceivers mounted outside of the casing. One of two underground transceivers has two toroid coils, one used as a transmitter and the other as a receiver. Another underground transceiver has a toroid coil acting as a reservoir. When an alternation current power is applied to the toroid coil acting as a transmitter, it induces an alternation current flowing along the casing and passing through the two toroid coils acting as receivers. The induced alternating current signals are measured by the transceivers and used by the chip of the transceiver to compute current flowing parameters between the two toroid coils acting as receivers of the transceivers. Then the current flowing parameters are used by the chip of the transceiver to calculate reservoir parameters. The current signals, current flowing parameters, and reservoir parameters are loaded into a low-frequency current generated by one of the transceivers, transmitted to the surface, and received by the surface control console for reservoir monitoring.

In one embodiment, the present invention provides a reservoir monitoring system. The reservoir monitoring system includes three underground transceivers mounted outside of a casing. One of the three underground transceivers has a toroid coil used as a transmitter, and the other two transceivers each have a toroid coil used as a receiver. While an alternation current power is applied to the toroid coil acting as the transmitter, it induces an alternation current flowing along the casing and passing through the two toroid coils acting as receivers. The induced alternating current signals at the toroid coils used as receivers are measured by the transceivers.

In one embodiment, the present invention provides a reservoir monitoring system. The reservoir monitoring system includes three underground transceivers mounted outside of a casing. One of the three underground transceivers has a toroid coil used as a transmitter, and the other two transceivers each have a toroid coil used as a receiver. While an alternation current power is applied to the toroid coil acting as transmitter, it induces an alternation current flowing along the casing and passing through the two toroid coils used as receivers. The induced alternating current signals at the toroid coils used as receivers are measured by the transceivers. The measured current signals are loaded into a low frequency current generated by one of the transceivers, and then transmitted to the surface through the low frequency current and received by surface control console. From the current signals, current flowing parameters between the two toroid coils acting as receivers of transceivers may be computed by the computer of the surface control console. The current flowing parameters are used to calculate reservoir parameters.

In one embodiment, the present invention provides a reservoir monitoring system. The reservoir monitoring system includes three underground transceivers mounted outside of a casing. One of the three underground transceivers has a toroid coil used as a transmitter, and the other two transceivers each have a toroid coil used as a receiver. While an alternation current power is applied to the toroid coil as a transmitter, it induces an alternation current flowing along the casing and passing through the two toroid coils as receivers. The induced alternating current signals at the toroid coils used as receivers are measured by the transceivers. The measured alternating current signals are used by the chip of the transceiver to compute the current flowing parameters between the two toroid coils as receivers of transceivers. The current signals and current flowing parameters are loaded into a low frequency current generated by one of the transceivers, then transmitted to the surface through the low-frequency current and received by a surface control console. The current flowing parameters are used to calculate reservoir parameters.

In one embodiment, the present invention provides a reservoir monitoring system. The reservoir monitoring system includes three underground transceivers mounted outside of a casing. One of the three underground transceivers has a toroid coil used as a transmitter, and the other two transceivers each have a toroid coil used as a receiver. While an alternation current power is applied to the toroid coil as a transmitter, it induces an alternation current flowing along the casing and passing through the two toroid coils as receivers. The induced alternating current signals at the toroid coils used as receivers are measured by the transceivers The measured alternating current signals are used by the chip of transceiver to compute the current flowing parameters between the two toroid coils as receivers of transceiver (s). The current flowing parameters are used by the chip of transceiver to compute reservoir parameters. The current signals, the current flowing parameters and the reservoir parameters are loaded on a low frequency current generated by one of the transceivers, and then transmitted to the surface through the low frequency current and received by surface control console.

In one embodiment, the present invention provides a reservoir monitoring system. The reservoir monitoring system includes two underground transceivers mounted outside a casing and one electrode installed inside of the casing. The two transceivers each has toroid coil as a receiver. While the electrode applies an alternation current, the current flows along the casing and passes through the two toroid coils. The alternating current signals are measured by the transceivers.

In one embodiment, the present invention provides a reservoir monitoring system. The reservoir monitoring system includes two underground transceivers mounted outside a casing and one electrode installed inside of the casing. The two transceivers each have toroid coil acting as a receiver. While the electrode applies an alternation current, the current flows along the casing and passes through the two toroid coils. The alternating current signals are measured by the transceivers and loaded into a low-frequency current generated by one of the transceivers, then transmitted to the surface through the low-frequency current and received by the surface control console. From the current signals, current flowing parameters between the two toroid coils of transceivers may be computed by the computer of the surface control console. The current flowing parameters are used to calculate reservoir parameters.

In one embodiment, the present invention provides a reservoir monitoring system. The reservoir monitoring system includes two underground transceivers mounted outside a casing and one electrode installed inside the casing. The two transceivers each has a toroid coil as a receiver. While the electrode emits an alternation current, the current will flow along the casing and passes through the two toroid coils. The alternating current signals are measured by the transceivers and used by the chips of the transceivers to compute the current flowing parameters between the two toroid coils. The current signals and current flowing parameters are loaded into a low-frequency current generated by one of the transceivers, then transmitted to the surface through the low-frequency current and received by the surface control console. The current flowing parameter is used by the computer of the surface control console to calculate reservoir parameters.

In one embodiment, the present invention provides a reservoir monitoring system. The reservoir monitoring system includes two underground transceivers mounted outside a casing and one electrode installed inside of the casing. The two transceivers each has toroid coil as a receiver. While the electrode applies an alternation current, the current will flow along the casing and passes through the two toroid coils. The alternating current signals are measured by the transceivers and used by the chips of the transceivers to compute the current flowing parameters between the two toroid coils. The current flowing parameters are used by the chips of the transceivers to compute the reservoir parameters. The current signals, and/or current flowing parameters, and/or the reservoir parameters are loaded into a low frequency current generated by one of the transceivers, then transmitted to the surface through the low frequency current and received by the surface control console.

In one embodiment, the present invention provides a reservoir monitoring system.

The reservoir monitoring system includes an electrode installed in a well and two underground transceivers mounted outside the casing of another well. Each of the transceivers has a toroid coil as a receiver. When an alternating current is applied to the electrode, a part of the current flows down the casing, goes through the formation between the two wells, then flows upward along the other well and passes through the two toroid coils. The alternating current signals at the two toroid coils are measured by the transceivers.

In one embodiment, the present invention provides a reservoir monitoring system. The reservoir monitoring system includes an electrode installed in a well and two underground transceivers mounted outside the casing of another well. Each of the transceivers has a toroid coil as a receiver. When an alternating current is applied to the electrode, a part of the current flows down the casing, goes through the formation between the two wells, then flows upward along the other well and passes through the two toroid coils. The alternating current signals at the two toroid coils are measured by the transceivers. The measured current signals are loaded into a low-frequency current generated by one of the transceivers, then transmitted to the surface through the low-frequency current and received by the surface control console. From the current signals, the current flowing parameters between the two toroid coils of transceivers may be computed by the computer of the surface control console. Then the current flowing parameters are used to calculate the reservoir parameters.

In one embodiment, the present invention provides a reservoir monitoring system. The reservoir monitoring system includes an electrode installed in a well and two underground transceivers mounted outside the casing of another well. Each of the transceivers has toroid coil as a receiver. When an alternating current is applied to the electrode, a part of the current flows down the casing, goes through the formation between the two wells, then flows upward along the other well and passes through the two toroid coils. The alternating current signals at the two toroid coils are measured by the transceivers and used by the chip of the transceivers to compute the current flowing parameters between the two toroid coils. The current signals and the current flowing parameters are loaded into a low frequency current generated by one of the transceivers, then transmitted to the surface through the low frequency current and received by the surface control console. From the current flowing parameters, the reservoir parameters may be computed by the computer of the surface control console.

In one embodiment, the present invention provides a reservoir monitoring system. The reservoir monitoring system includes an electrode installed in a well and two underground transceivers mounted outside the casing of another well. Each of the transceivers has a toroid coil as a receiver. When an alternating current is applied to the electrode, a part of the current flows down the casing, goes through the formation between the two wells, then flows upward along the other well and passes through the two toroid coils. The alternating current signals at the two toroid coils are measured by the transceivers and used by the chip of the transceivers to compute the current flowing parameters between the two toroid coils. The computed current flowing parameters are used by the chip of the transceivers to compute the reservoir parameters. The current signals, the current flowing parameters and the reservoir parameters are loaded into a low frequency current generated by one of the transceivers, then transmitted to the surface through the low frequency current and received by the surface control console.

In one embodiment, the present invention provides a reservoir monitoring system measuring the alternating current phase difference and amplitude decay between transceivers. The ratio, $$\frac{V_2}{V_1},$$

may be used to compute the phase difference and current amplitude decay while an alternating current passes through two transceivers, where $V_1$ is the measurement of the transceiver1, and $V_2$ is the measurement of the transceiver2.

In one embodiment, the present invention provides a reservoir monitoring system for measuring the phase velocity while an alternating current flowing between two toroid coils of transceivers.

$$\text{Using Ratio} = \frac{V_2}{V_1}$$

to compute the phase difference, Dphase, $$\text{Phase velocity } V^p = 2\pi f \frac{L}{\text{Phase}},$$

where L is the spacing between two toroid coils of transceivers, f is the frequency, $V_1$ is the measurement of the transceiver1, and $V_2$ is the measurement of the transceiver2.

In one embodiment, the present invention provides a reservoir monitoring system for measuring the alternating current decay while an alternating current flowing between two transceivers.

$$\text{Ratio} = \frac{V_2}{V_1},$$

The current amplitude attenuation may be expressed as Att=−20 log (|Ratio|), where $V_1$ is the measurement of the transceiver1, and $V_2$ is the measurement of the transceiver2.

In one embodiment, the present invention provides a reservoir monitoring system for measuring the current flowing time between toroid coils of transceivers.

$$\text{Time} = \frac{L}{V^g},$$

where $V^g$ is group velocity.

In one embodiment, the present invention provides a reservoir monitoring system. The reservoir monitoring system includes two transceivers mounted outside of a casing, one located underground and the other near the earth surface. While an alternation current power is applied to the toroid coil acting as a transmitter of the transceiver underground, it induces an alternating current flowing along the casing, through the reservoir, received by a transceiver near the surface, and recorded by the surface control console. The computer in the surface control console is used to compute the alternating current flowing time between the two transceivers. The reservoir monitoring system realizes the monitoring of a reservoir according to the alternating current time changes measured at different times.

In one embodiment, the present invention provides a reservoir monitoring system. The reservoir monitoring system includes an alternating current source installed bellow a reservoir and one receiver located near the earth surface. While an alternation current power is applied to alternating current source, the alternating current flows along the casing, through the reservoir, received by the reservoir, and recorded by the surface control console. The computer in the surface control console is used to compute the alternating current flowing time between the two transceivers. The reservoir monitoring system realizes the monitoring of a reservoir according to the alternating current time changes measured at different times.

In one embodiment, the present invention provides a reservoir monitoring system including two electrodes mounted along a casing for measuring a voltage induced by a current flowing between the two electrodes along the casing.

In one embodiment, the present invention provides a reservoir monitoring system that operates at multiple frequency.

In one embodiment, the present invention provides a reservoir monitoring system that may take measurements at different times.

In one embodiment, the present invention provides a reservoir monitoring system having a computer to calculate alternating current phase shift, amplitude decay, current flowing velocity, and current flowing time between two transceivers.

In one embodiment, the present invention provides a reservoir monitoring system having chip to compute alternating current phase shift, amplitude decay, current flowing velocity, and current flowing time between two transceivers.

In one embodiment, the present invention provides a reservoir monitoring system that includes acoustic sensors in transceiver.

In one embodiment, the present invention provides a reservoir monitoring system that includes neutron sensors in transceiver.

In one embodiment, the present invention provides a reservoir monitoring system including pressure sensors in transceiver.

In one embodiment, the present invention provides a reservoir monitoring system including temperature sensors in transceiver.

In one embodiment, the present invention provides a reservoir monitoring system measuring reservoir parameters, such as resistivity, porosity, permeability, and water saturation at fixed intervals.

In one embodiment, the present invention provides a reservoir monitoring system including a transceiver having a toroid coil mounted outside casing. The toroid coil receives data measured by logging while drilling tools and transmitted through a drilling pipe and casing. The transceiver acts as a relay transmitting message between a surface drilling control system and logging while drilling tools. The surface drilling control system includes computer, monitors, control board and power.

In one embodiment, the present invention provides a reservoir monitoring system including transceiver installed on the cable connecting multi-wells. The transceiver receives data measured by logging while drilling tools and transmitted through a drilling pipe and casing. The transceiver acts as a relay transmitting message between a surface drilling control system and logging while drilling tools. The surface drilling control system includes computer, monitors, control board and power.

In one embodiment, the present invention provides a reservoir monitoring system including multiple transceivers operating with multiple operation frequency. The measurements such as formation resistivities are used to compute formation resistivity distribution by inversion.

In one embodiment, the present invention provides a reservoir monitoring system including transceiver having eclectic gap used as transmitter and/or receiver.

In one embodiment, the present invention provides a reservoir monitoring system that includes marks, such as cavities in the inner wall of the casing, for indicating the depth location of the transceiver.

In one embodiment, the present invention provides a reservoir monitoring system including marks, such as cavities in the inner wall of the casing, for indicating the azimuthal position of a cable connecting the transceiver underground and the surface control console.

What is claimed is:

1. A device for monitoring a reservoir underground comprising:

a surface control console, a power source to supply an alternating current flowing through the reservoir through a casing, a first toroid coil mounted underground and outside of the casing, wherein the first toroid coil is configured as a first transmitter to generate an alternating current flowing through the casing, and the casing passes through the first toroid coil, a second toroid coil configured to operate as a first receiver and mounted underground outside the casing, and the casing passes through the second toroid coil, and a processor configured for calculating a parameter selected from the group consisting of a first parameter, a second parameter, and a combination thereof, wherein the first parameter is a parameter of an alternating current induced by the first toroid coil flowing along through the casing selected from the group consisting of phase velocity, group velocity, phase difference, amplitude decay, time difference, and combinations thereof, while the alternating current passes through the reservoir through the casing based on a current signal, and the second parameter is selected from the group consisting of reservoir resistivity, which is computed from the first parameter, reservoir water saturation, which is computed from the reservoir resistivity, and a combination thereof, wherein:

the second toroid coil is configured to measure a voltage parameter induced by the alternating current signal flowing through the casing, and the voltage parameter is selected from the group consisting of real part, image part, phase, amplitude, and combinations thereof, at least one of the first and second toroid coils is capable of transferring data to the surface control console and receiving an operation command issued by the surface control console; and the first parameter is calculated by the processor based on the voltage parameter.

2. The device according to claim 1 further comprising a third toroid coil configured to operate as a second receiver, mounted underground outside the casing, and configured to measure the voltage parameter, wherein the casing passing through the third toroid coil.

3. The device according to claim 2 comprising an electrode located inside the casing; when the electrode emits an alternating current flowing through the casing, the first and second receivers measure the voltage parameter, as the alternating current passes through the first and second receivers.

4. The device according to claim 2 comprising an electrode located outside of the casing; when the electrode emits an alternating current flowing through the casing, the first and second receivers measure the voltage parameter as the alternating current passes through the first and second receivers.

5. The device according to claim 2 comprising an electrode installed in a first well, wherein the first and second receivers are both mounted outside the casing of a second well; as the electrode sends an alternating current, the alternating current passes through formation between the first and second wells and flows through the casing of the second well, the first and second receivers measure the voltage parameter as the alternating current passes through the first and second receivers.

6. The device according to claim 1 comprising a conductive cable connecting two wells for receiving data transmitted from underground and sending operation commands issued by the surface control console to the underground, wherein an alternating current measuring circuit is installed on the conductive cable.

7. The device according to claim 1 comprising a conductive cable connecting two wells and the first toroid coil to supply an alternating current passing through the reservoir and the casing, wherein the alternating current signal is measured by an alternating current measuring circuit installed on the conductive cable and received by the surface control console.

8. The device according to claim 1 comprising a first, a second, and a third coil antennae mounted outside casing of a well; wherein the first coil antenna emits an electromagnetic wave passing through the second and third coil antennae, and the second and third coil antennae measure signals of the electromagnetic wave passing through the second and third coil antennae for computing phase attenuation and phase difference of the electromagnetic wave propagating between the second and third coil antennae, and then the at least one reservoir parameter based on the phase attenuation and the phase difference of the electromagnetic wave, therefore monitoring the reservoir based on the second parameter.

* * * * *